United States Patent [19]

Ikeda

[11] 4,434,630

[45] Mar. 6, 1984

[54] WASHER-DEHYDRATOR

[75] Inventor: Yoshio Ikeda, Aichi, Japan

[73] Assignee: Tokyo Shibaura Denki Kabushiki Kaisha, Kawasaki, Japan

[21] Appl. No.: 353,382

[22] Filed: Mar. 1, 1982

[30] Foreign Application Priority Data

Mar. 15, 1981 [JP] Japan ..... 56-31744

[51] Int. Cl.[3] ..... D06F 17/06; D06F 23/04

[52] U.S. Cl. ..... 68/18 F; 68/23.6; 68/53

[58] Field of Search ..... 68/18 F, 23.6, 53, 133

[56] References Cited

FOREIGN PATENT DOCUMENTS 229806 8/1960 Australia ..... 68/23.6
35-4288 3/1960 Japan .
47-35676 12/1972 Japan .
52-131661 11/1977 Japan .
53-126772 11/1978 Japan ..... 68/133
54-112568 9/1979 Japan .

*Primary Examiner*—Philip R. Coe
*Attorney, Agent, or Firm*—Cushman, Darby & Cushman

[57] ABSTRACT

In a washer-dehydrator, an eccentrically set pulsator is driven through a rotation moment-transmitting mechanism, and, even in case washing water streams containing foreign matter are drawn below the pulsator by the action of pumping blades mounted on the underside of the pulsator. The operation of the rotation moment-transmitting mechanism is not obstructed by the foreign matter, but circulating water streams can be smoothly produced to trap foreign matter retained in the washing water.

7 Claims, 4 Drawing Figures

FIG. 3
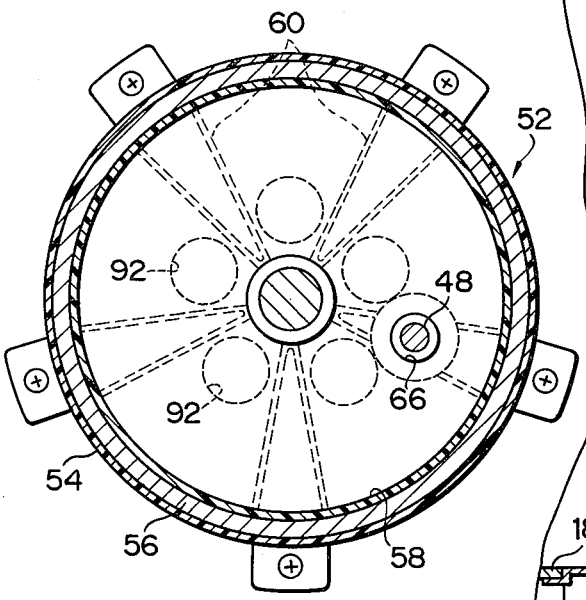
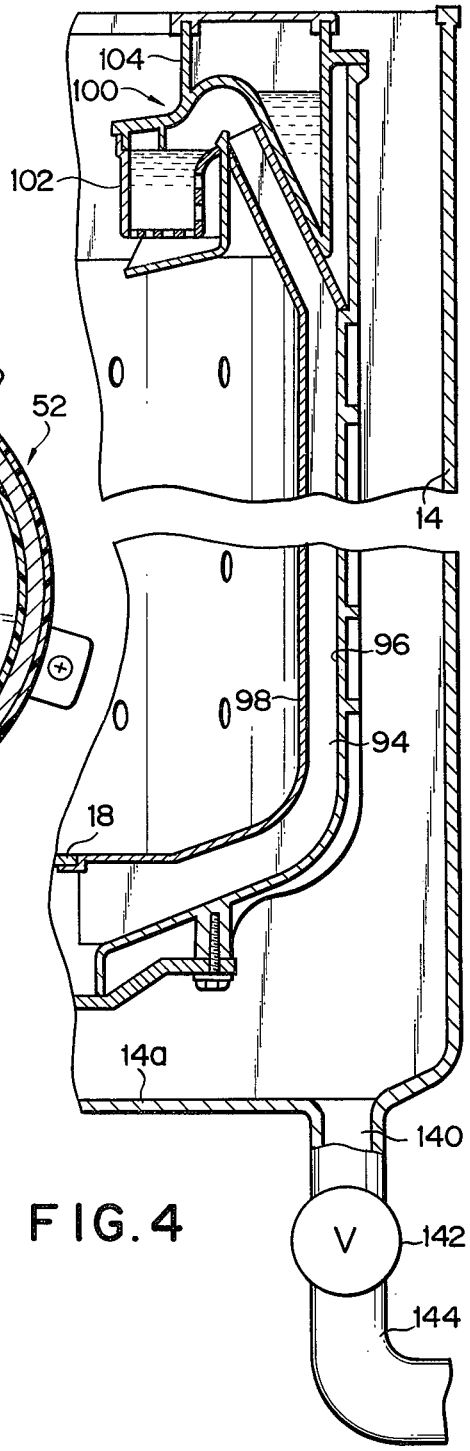
FIG. 4

WASHER-DEHYDRATOR

BACKGROUND OF THE INVENTION

This invention relates to a washer-dehydrator which is provided with a pulsator, and more particularly to a washer-dehydrator so arranged as to trap lint or fluffy material floating in the washing water.

Conventionally, a pulsator of a washer-dehydrator is set at the center of the bottom board of a rotary tank. The underside of the pulsator is fitted with a plurality of pumping blades to produce circulating water streams intended to trap lint or fluffy substance floating in the washing water. The pumping blades pump up the washing water held in the rotary tank with the rotation of the pulsator. The pumped washing water passes through a filter while flowing back from above into the rotary tank. The lint or fluffy substance remaining in the washing water is trapped by the filter.

Recently, it has been thought of eccentrically positioning the pulsator on the bottom of the washing tank to generate complex circulating water streams in the washing tank, thereby enhancing the washing efficiency.

To date, however, no washer-dehydrator has been put to practical application wherein a pulsator is eccentrically mounted on the bottom board of a rotary tank and circulating water streams are produced by the pumping blades fitted to the underside of the pulsator, in order to trap lint or fluffy substance remaining in the washing water. The reason is that where washing water is drawn below the pulsator by the pumping action of the pumping blades fitted to the underside of the pulsator when it is rotated, then the washing water, together with foreign matter such as lint, flows below the pulsator, thereby presenting the difficulties that the foreign matter is caught in the gear mechanism or clings to the pulsator shaft.

SUMMARY OF THE INVENTION

This invention has been accomplished in view of the above-mentioned circumstances and is intended to provide a washer-dehydrator which enables an eccentrically set pulsator to be driven through a rotation moment-transmitting mechanism, and, even when washing water containing foreign matter is drawn below the eccentric pulsator by the action of the pumping blades of the eccentric pulsator, prevents the foreign matter from obstructing the operation of the rotation moment-transmitting mechanism, and produces circulating water streams to trap foreign matter retained in the washing water.

To attain the above-mentioned object, this invention provides a washer-dehydrator, wherein an eccentrically set pulsator is driven through a rotation moment-transmitting mechanism, and, even in case washing water streams containing foreign matter are drawn below the pulsator by the action of the pumping blades mounted on the underside of the pulsator, the operation of the rotation moment-transmitting mechanism is not obstructed by the foreign matter, but circulating water streams can be smoothly produced to trap foreign matter retained in the washing water.

According to an aspect of the present invention, there is provided a washer-dehydrator which comprises a water holder; a rotary tank which is rotatably held in the water holder, and which has a depression eccentrically positioned therein and at least one communication hole for communicating the water holder therewith; a pulsator rotatably fitted into the depression; a pulsator shaft concentrically fitted to the pulsator; a washing shaft concentrically fitted to the rotary tank; a rotation moment-transmitting mechanism provided between the washing shaft and pulsator shaft to transmit the rotation moment of the washing shaft to the pulsator shaft; a sealed case for covering the rotation moment-transmitting mechanism in a watertight state which is set below the pulsator in the depression at a point raised above the base of the depression at a prescribed distance; a penetrating hole formed in the depression to let the depression communicate with a space defined between the rotary tank and water holder; a water circulation path which is provided in the rotary tank, one end of which is open to the depression, and the other end of which is positioned above the highest level of water received in the rotary tank; a filter mechanism which includes an inlet connected to the other end of the water-circulation path and an outlet opened to the inside of the rotary tank, and which filters water running therethrough; and a large number of pumping blades fitted to the underside of the pulsator around the sealed case, which, when the pulsator is rotated, draws the water held in the rotary tank into the depression through the communication hole and penetrating hole, and sends forth the water held in the depression to the filter mechanism through the water-circulation path.

BRIEF DESCRIPTION OF THE DRAWINGS

FIG. 3 is a cross sectional view of a sealed case shown in FIG. 2; and

FIG. 4 is a longitudinal sectional view of the water-circulation path and filtering mechanism of the washer-dehydrator of FIG. 1.

DETAILED DESCRIPTION OF THE PREFERRED EMBODIMENT

Detailed description is now given with reference to the accompanying drawings of a washer-dehydrator embodying this invention.

Figure 1:
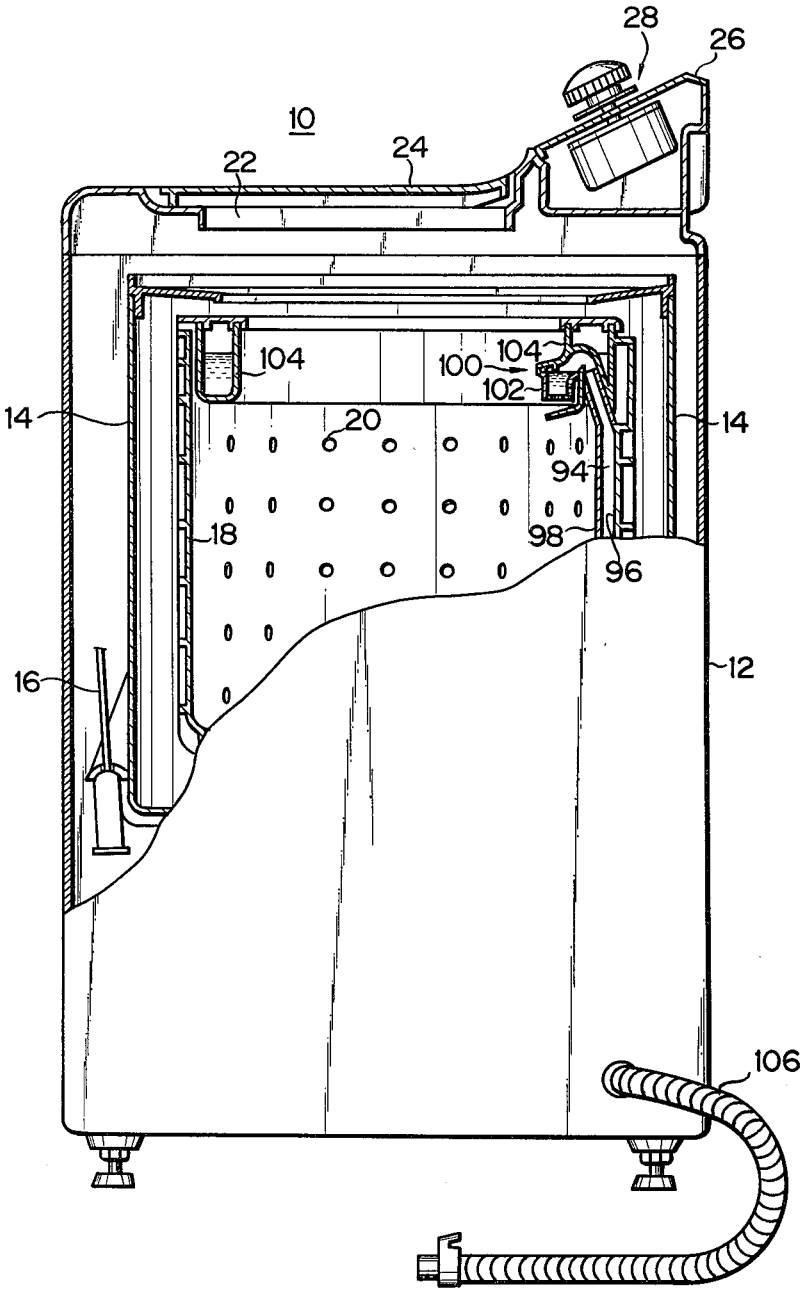
FIG. 1 is a side view, partly in section, of one embodiment of a washer-dehydrator according to this invention.

As seen from FIG. 1, a washer-dehydrator 10 (hereinafter referred to as "a fully automatic washer") comprises an outer case 12 opened at the top. A water tank 14 is suspended in the outer case 12 elastically and unrotatably by means of a suspending rod 16 of an elastic suspending mechanism (not shown). A rotary tub 18 is rotatably set in the water tank 14. This rotary tub 18 whose peripheral wall is provided with a large number of water-draining ports carries out washing and also dehydrating. An opening at the top of the outer case 12 allows for the taking in and out of a washing. A cover 24 is mounted on the outer case 12 to close the opening 22. An operation box 26 fitted to the upper rear surface of the outer case 12 is provided with a time switch 28 to control the selected washing program.

Figure 2:
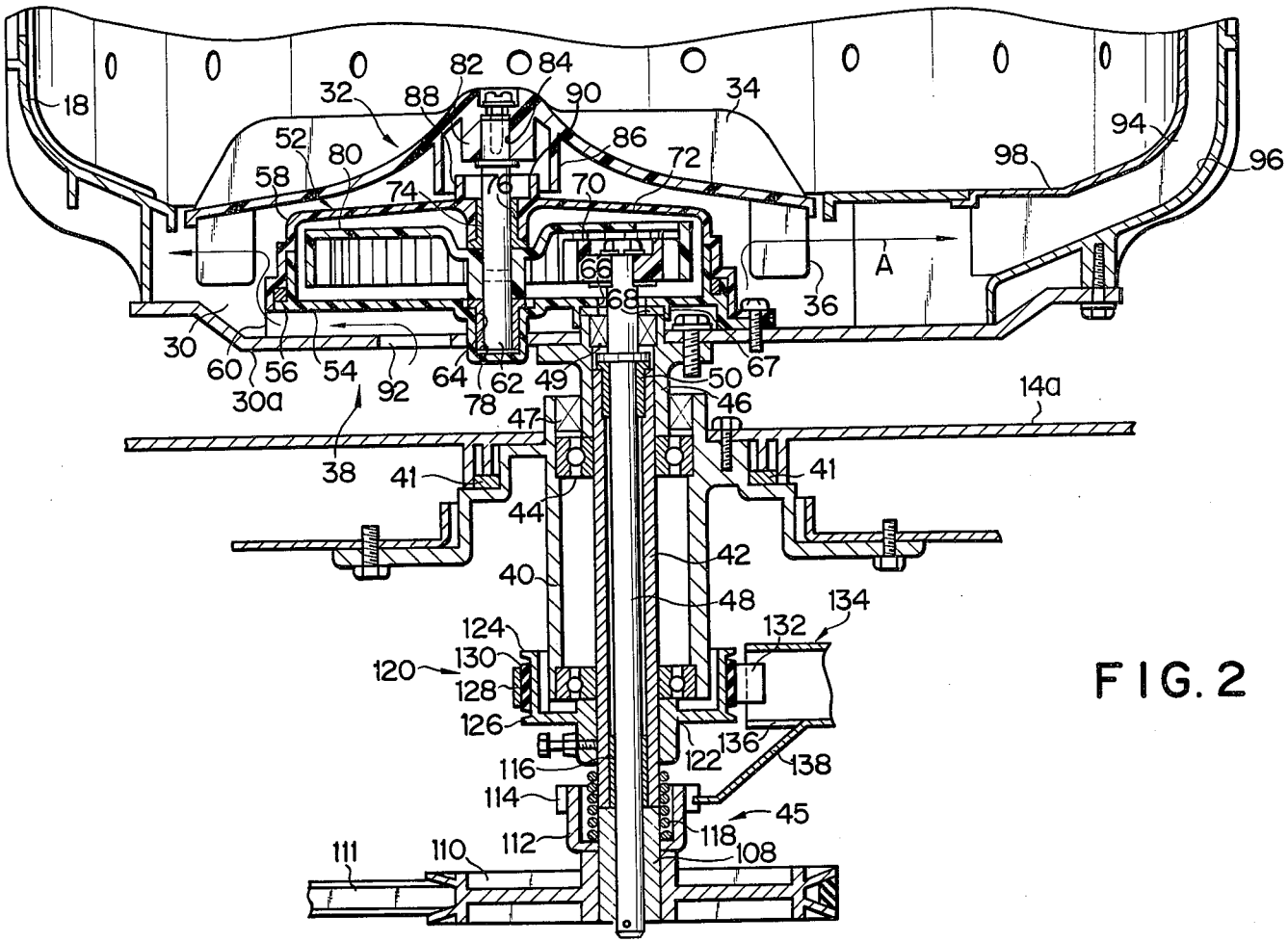
FIG. 2 is a longitudinal sectional view of a drive mechanism of the rotary tank and pulsator of the washer-dehydrator of FIG. 1.

As shown in FIG. 2, a circular depression 30 is eccentrically positioned at the bottom of the rotating tub 18. A pulsator 32 is rotatably set in the circular depression 30. The pulsator 32 comprises a plurality of stirring blades 34 arranged over the upper surface thereof and a plurality of pumping blades 36 arranged on the periphery of the underside thereof to carry out a pumping function.

Description is now given of a drive mechanism 38 of the rotary tub 18 and pulsator 32. As seen from FIG. 2, a housing 40 is fixed to the center of the bottom board 14*a* of the water tank 14 to vertically penetrate the bottom board 14*a* of the water tank 14. The water tank 14 and housing 40 are held in a watertight state by means of a sealing member 41. A hollow cylindrical dehydrating shaft 42 vertically penetrates the central portion of the housing 40 in a state rotatable by a bearing 44. The upper end of the dehydrating shaft 42 is positioned between the bottom board 14*a* of the water tank 14 and the bottom board 30*a* of the depression 30 of the rotary tub 18. A cylindrical member 46 is fitted to the upper end of the dehydrating shaft 42. The cylindrical member 46 is fixed to the center portion of the bottom board 30*a* and penetrating the same. Where the dehydrating shaft 42 is rotated, the rotary tub 18 is jointly rotated. The cylindrical member 46 and housing 40 are held in a watertight state by means of a sealing member 47.

A washing shaft 48 is rotatably received in the dehydrating shaft 42 by means of a bearing 50. The washing shaft 48 is a solid cylindrical member, whose upper end is set in the depression 30 of the rotary tank 18 below the pulsator 32. A space defined between the washing shaft 48 and cylindrical member 46 is rendered watertight by means of a sealing member 47. The dehydrating shaft 42 is connected to a common drive source for the washing shaft 48 by means of the later described clutch mechanism 45.

A sealed case 52 is held in the depression 30 of the rotary tub 18. The sealing case 52 comprises a lower case section 54 and an upper case section 58 connected to the lower case section 54 in a watertight state by means of a sealing 56. A plurality of radially extending guide walls 60 are integrally formed on the underside of the lower case section 54 (FIG. 3). Formed in the center of the lower case section 54 is a small depression 64 into which the lower end portion of the later described pulsator shaft 62 is fitted. The lower case section 54 is threadedly fixed to the base board 30*a* with guide walls 60 interposed therebetween. In other words, a space having a prescribed height is provided between the underside of the lower case section 54 and the upper plane of the depression 30. A penetrating hole 66 is formed in that portion of the lower case section 54 which faces the center of the rotary tank 18. The upper end portion of the previously described washing shaft 48 is conducted into the sealed case 52 through the penetrating hole 66.

A downward extending annular rib 67 is formed on that portion of the underside of the lower case section 54 which surrounds the penetrating hole 66. The lower end portion of the annular rib 67 is positioned near the upper end portion of the cylindrical member 46. A sealing member 68 is provided between the annular rib 67 and cylindrical member 46, thereby preventing water from seeping into the sealed case 52. A drive gear 70 made of, for example, plastics material is threadedly fixed to the upper end portion of the washing shaft 48 which is received in the sealed case 52. This drive gear 70 having a small number of teeth constitutes one component of a gear mechanism 72 acting as rotation moment-transmitting means.

A penetrating hole 74 is formed in that portion of the upper case section 58 which lies right above the small depression 64 of the lower case section 54. The pulsator shaft 62 extends through the penetrating hole 74 in a state rotatable by means of a bearing 76. The lower end portion of the pulsator shaft 62 is fitted into the small depression 64 of the lower case section 54 in a state rotatable by means of a bearing 78. An internal driven gear 80 made of, for example, plastics material is concentrically fixed to that portion of the pulsator shaft 62 which is received in the sealed case 52. This driven gear 80 having a large number of teeth is threadedly engaged with the aforesaid drive gear 70, and acts as the other component of the gear mechanism 72.

The pulsator 32 is provided at the center with a thick boss section 82. A cavity 84 is formed with a prescribed depth at the center of the underside of the boss section 82 to hold the upper end portion of the pulsator shaft 62. The pulsator 32 is threadedly fixed to the upper end portion of the pulsator shaft 62 in a concentric relationship therewith. Where, therefore, the washing shaft 48 is rotated, the pulsator 32 is also rotated by means of the gear mechanism 72 and pulsator shaft 62.

A downward extending annular shield 86 is integrally formed on that portion of the underside of the pulsator 32 which surrounds the boss section 82. An upward extending annular rib 88 is integrally formed on that portion of the top surface of the upper case section 58 which surrounds the penetrating hole 74. The lower end portion of the annular shield 86 extends to the outer peripheral space of the annular rib 88. A sealing member 90 is interposed between the annular rib 88 and pulsator shaft 62, thereby preventing water from seeping into the sealed case 52 through the penetrating hole 74.

A plurality of water-introducing ports 92 (FIG. 3) are drilled in that portion of the base board 30*a* which lies below the sealed case 52, around the center of that portion. The water-introducing ports 92 are respectively interposed between every adjacent guide walls 60. That space of the depression 30 which is positioned below the pulsator 32 communicates with the internal space of the rotary tub 18 through a gap defined between the sealed case 52 and the base board 30*a*, water-introducing ports 92, a space defined between the base board 30*a* and the bottom board 14*a* of the water tank 14, and the water-discharging ports 20 of the rotary tub 18.

A water-circulation path 94 is provided inside of the rotary tub 18 (FIG. 4). This water-circulation path 94 comprises a groove section 96 which vertically extends through the peripheral wall of the rotary tub 18 and extends through the bottom portion of the rotary tub 18 up to the depression 30, and a cover 98 closing the groove section 96. The lower end of the water-circulation path 94 is opened to the depression 30. The upper end of the water-circulation path 94 is held above the highest water level of the rotary tub 18. The upper end of the water-circulation path 94 is open to a filter mechanism 100, to which a filter 102 is detachably fitted. An annular ballast ring 104 is set on the upper edge of the rotary tub 18 to allow for its smooth high speed rotation when water is discharged.

Description is now given with reference to FIG. 2 of the clutch mechanism 45. A driven pulley 110 is concentrically fixed to the lower end of the washing shaft 48 by means of a sleeve shaft 108. A belt 111 is stretched between a drive source, for example, a motor (not shown) and the pulley 110, causing the washing shaft 48 to be always rotated with the drive of the motor.

A rotatable clutch sleeve 112 is concentrically fitted into that outer peripheral wall of the sleeve shaft 108 which lies above the pulley 110. The lower end of the clutch sleeve 112 is slidably touched the outer peripheral wall of the sleeve shaft 108. That portion of the clutch sleeve 112 which lies above its lower end portion is formed spatially from the outer peripheral wall of the sleeve shaft 108. A sawtooth gear 114 is fixed to the outer peripheral wall of the upper end portion of the clutch sleeve 112. The lower end edge of the dehydrating shaft 42 terminates at the upper end of the sleeve shaft 108. A bearing 116 is provided between the lower end of the dehydrating shaft 42 and the washing shaft 48. The outer peripheral wall of the dehydrating shaft 42 and that of the sleeve shaft 108 are made flush with each other. A clutch coil spring 118 is inserted into a space provided in the clutch sleeve 112 in such a manner that the lower end of the clutch coil spring 118 is fixed to the clutch sleeve 112. The turns of the clutch coil spring 118 are wound around the outer peripheral wall of the sleeve shaft 108 and that of the dehydrating shaft 42 in the same direction as that in which the pulley 110 is rotated in the dehydrating operation. The lower end portion of the clutch coil spring 118 is always frictionally engaged with the outer peripheral wall of the sleeve shaft 108. The upper portion of the clutch coil spring 118 is frictionally engaged with the outer peripheral wall of the dehydrating shaft 42, when the clutch coil spring 118 is rotated in the same direction as that in which the turns of the clutch coil spring 118 are wound.

A brake mechanism 120 is fitted to that portion of the dehydrating shaft 42 which lies above the clutch mechanism 45. This brake mechanism 120 comprises a brake drum 122 fixed to the dehydrating shaft 42. The outer peripheral wall of the brake drum 122 is cylindrically formed. The upper and lower edges of the brake drum 122 are respectively provided with outward projecting collar members 124, 126. The outer peripheral wall of the brake drum 122 acts as a brake surface. A brake band 128 is loosely fitted around the outer peripheral wall of the brake drum 122 with a rubber brake lining 130 interposed therebetween. The brake lining 130 is frictionally engaged with the outer peripheral wall of the brake drum 122. The brake band 128 is shaped like the letter C as viewed from above. An outward projecting tongue member 132 is integrally formed on part of the outer peripheral wall of the brake band 128.

A control lever 134 is provided along the brake mechanism 120 in a state movable relative to the dehydrating shaft 42. The control lever 134 comprises a first engagement section 136 which is engageable with the tongue member 132 when the control lever 134 approaches the dehydrating shaft 42 and a second engagement section 138 which is engageable with the gear 114 of the clutch mechanism 45 a little earlier than the engagement of the first engagement section 136 with the tongue member 132. In the dehydrating operation, the control lever 134 is removed from the dehydrating shaft 42, causing the first and second engagement sections 136, 138 to be disengaged from the tongue member 132 and gear 114, respectively. Where, therefore, washing is dehydrated, the brake mechanism 120 is not operated, and the dehydrating shaft 42 is rendered rotatable. The gear 114 of the clutch mechanism 45 is disengaged from the second engagement section, enabling the clutch sleeve 112 to be rotated with the sleeve shaft 108. The clutch sleeve 112 is rotated in the same direction as that in which the turns of the clutch coil spring 118 are wound. As a result, the clutch spring 118 is more compressed as the rotation of the clutch sleeve 112 proceeds. Therefore, the upper section of the clutch coil spring 118 is frictionally engaged with the dehydrating shaft 42 to allow for its rotation. Namely, when the washing is dehydrated, the dehydrating shaft 42 is rotated with the washing shaft 48.

On the other hand, in the washing operation, i.e. detergent washing operation and rinsing operation, the control lever 134 is moved toward the dehydrating shaft 42, and the first and second engagement sections 136, 138 are engaged with the tongue member 132 and gear 114 respectively. In the washing operation, therefore, the brake mechanism 120 is actuated to prevent the dehydrated shaft 42 from being rotated. The gear 114 of the clutch mechanism 45 is engaged with the second engagement section 138, preventing the clutch sleeve 112 from being rotated regardless of the rotation of the sleeve shaft 108. Namely, in the washing operation, only the washing shaft 48 is rotated, and the dehydrating shaft 42 is not rotated.

Where the opening of the cap 24 is detected in the dehydrating operation, then the control lever 134 is drawn toward the dehydrating shaft 42, thereby stopping its rotation and the drive of the motor.

As shown in FIG. 4, the water tank 14 is provided with a water-draining port 140, which communicates with a water-draining path 144 through a water-draining valve 142. A water-draining pipe 106 (FIG. 1) is detachably fitted to the water-draining path 144. The operation of the water-draining valve 142 is controlled by the time switch 28 and water level detector (not shown).

Description is now given of the operation of a fully automatic washing machine 10 embodying this invention constructed as described above.

A proper quantity of washing is put into the rotary tub 18 through the opening 22 together with detergent. Later when the time switch 28 is set at a desired program, then washing by detergent is commenced. At this time, a water-supplying valve (not shown) is opened to conduct water into the rotary tub 18. Where the supplied water reaches a prescribed level, then a level gauge (not shown) is actuated to close the water-supplying valve. At this time, a motor (not shown) is started to rotate the washing shaft 48. The driving force of the motor is transmitted at a reduced state by means of the gear mechanism 72, causing the pulsator 32 to be rotated at a low speed. The stirring of water caused by the rotation of the pulsator 32 produces vortical water streams in the rotary tub 18. Since the pulsator 32 is eccentrically set in the rotary tub 18, water flows in extremely complicated vortical streams. As a result, the washing is fully stirred, and effectively cleaned, because its increased contact with pulsator 32 is assured.

Where the pulsator 32 is rotated, the pumping action of the blades 36 causes water filled in the water tank 14 to be drawn into the circular depression 30 through the water-introducing port 92. The sucked water is forced into the circulation path 94 along a line indicated by an arrow A in FIG. 2. The water brought into the circulation path 94 is forced upward into the filter mechanism 100 from the upper end portion of the circulation path 94. Foreign matter such as lint or fluffy material retained in the water is trapped by the filter 102 of the filter mechanism 100. The filtered water is brought back into the rotary tub 18. After performing the detergent washing operation, the water returned to the rotary tub 18 runs into the water tank 14 through the water-draining ports 20.

The water held in the rotary tub 18 is forcefully circulated through the water-circulation path 94 by the repetition of the above-mentioned operation. While the circulating water passes through the filter 102, the lint or fluffy material contained in the water is trapped by the filter 102, thereby preventing the lint or fluffy material from clinging to the washing.

Where the washing detergent operation is completed, a water draining operation begins. Namely, the water-draining valve 142 is opened to cause the water received in the rotary tub 18 and water tank 14 to drain through the water-draining pipe 106 (FIG. 1). Where the water-draining operation is brought to an end, the water dehydrating operation begins. Namely, the rotating moment of the motor is transmitted to the dehydrating shaft 42 through the clutch mechanism 45. The drive of the motor causes the rotary tub 18 to be rotated at a high speed. As a result, the water soaked in the washing is centrifugally drawn off. The removed water is discharged out of the washing machine through the water draining ports 20 of the rotary tub 18. Where the dehydrating of water is brought to an end, the water-draining valve 142 is closed. The water-supplying valve is opened to commence a rinsing operation. The rinsing and water draining operations are repeated several times and finally the dehydrating operation starts to complete the washing function.

With the washing machine embodying this invention, the pumping action of the pumping blades 36 mounted on the underside of the pulsator 32 causes water to be sucked below the pulsator 32. Since the gear mechanism 72 is covered in a watertight state by the sealed case 52, foreign matter such as lint or fluffy material contained in the water is effectively prevented from being caught in the gear mechanism 72.

The pulsator shaft 62 projects upward from the upper case section 58 of the sealed case 52. The circulating water supposedly containing lint or fluffy material flows into the depression 30 through the water-sucking ports 92 formed on the bottom board **30*a* positioned below the sealed case 52, and runs into a space provided outside of the sealed case 52 along the underside thereof and the guide walls 60. The circulating water is immediately drawn toward the pumping blades 36. Therefore, the circulating water is substantially prevented from flowing to the upper portion of the sealed case 52, namely, the proximity of that portion of the pulsator shaft 62 which projects from the sealed case 52. Therefore, foreign matter such as lint or fluffy material is prevented from clinging to the pulsator shaft 62 or being caught between the pulsator shaft 62 and sealing member 90. Particularly with the embodiment of this invention, shielding walls 86 are provided on the underside of the pulsator 32 in a state surrounding the pulsator shaft 62, thereby reliably preventing foreign matter such as lint or fluffy material from sticking to the pulsator shaft 62**.

Further with the embodiment of the invention, a plurality of radially extending guide walls 60 are arranged between the bottom board of the sealed case 52 and the base board **30*a*. Consequently, the water running into the depression 30 through the sucking ports 92 are smoothly conducted to the pumping blades 36 of the pulsator 32 by means of the guide walls 60. The above-mentioned arrangement enables the washing water to flow smoothly, thereby elevating the pumping efficiency. The guide walls 60 are integrally formed on the lower case section 54 of the sealed case 52, and consequently act not only as the reinforcement of the lower case section 54 but also as a spacer. Therefore, a space defined between the lower case section 54 of the sealed case 52 and the base board 30*a* of the depression 30** is made to reliably have prescribed dimensions.

This invention is not limited to the above-mentioned embodiment, but may be practiced in various modifications without departing from the object of the invention. For instance with the aforesaid embodiment, the rotation moment-transmitting mechanism was formed of a gear system. However, this process need not be restrictively followed. Namely, the rotation moment-transmitting mechanism may consist of a belt, friction wheel, chain, etc. Further, the guide walls 60 may be integrally formed on the base board **30*a* of the depression 30**.

What is claimed is:

1. A washer-dehydrator which comprises:

a water tank;

a rotary tub which is rotatably held in the water tank and which has a depression eccentrically positioned therein and at least one communication hole for communicating the water tank therewith;

a pulsator rotatably fitted into the depression;

a pulsator shaft concentrically fitted to the pulsator;

a washing shaft concentrically fitted to the rotary tub;

a rotation moment-transmitting mechanism provided between the washing shaft and pulsator shaft to transmit the rotation moment of the washing shaft to the pulsator shaft;

a sealed case for covering the rotation moment-transmitting mechanism in a watertight state which is set below the pulsator in the depression at a point raised above the base of the depression at a prescribed distance, said base of the depression having a penetrated hole therein to let said depression communicate with a space defined between the rotary tub and water tank;

a water-circulation path which is provided in the rotary tub, one end of which is opened to the depression, and the other end of which is positioned above the highest level of water received in the rotary tub;

a filter mechanism which includes an inlet connected to said other end of the water-circulation path and an outlet opened to the inside of the rotary tub, and which filters water running therethrough;

a plurality of pumping blades fitted to the underside of the pulsator around the sealed case, which, when the pulsator is rotated, draws the water held in the rotary tub into the depression through the communication hole and penetrated hole, and sends forth the water held in the depression to the filter mechanism through the water-circulation path; and guide means provided between the sealed case and the base plate of the depression to conduct the water sucked through the penetrating hole to the outer peripheral wall of the sealed case.

2. The washer-dehydrator according to claim 1, wherein the guide means comprises a plurality of guide walls radially extending from the center of the sealed case.

3. The washer-dehydrator according to claim 2, wherein the guide walls are integrally formed on the bottom board of the sealed case.

4. The washer-dehydrator according to any one of the preceding claims, wherein said pulsator has an annular shielding wall on the underside thereof in a state surrounding the pulsator shaft.

5. The washer-dehydrator according to claim 4, wherein said sealed case has an annular rib on the upperside thereof in a state surrounding the pulsator shaft.

6. The washer-dehydrator according to claim 5, wherein the annular shielding wall extends downward to the periphery of the annular rib.

7. The washer-dehydrator according to claim 2, wherein the base plate of the depression includes a plurality of water-introducing ports disposed around the center of the sealed case, each of said ports being positioned between respective adjacent guide walls.

* * * * *